US009681756B2

(12) United States Patent
Smith

(10) Patent No.: US 9,681,756 B2
(45) Date of Patent: Jun. 20, 2017

(54) ERGONOMIC SUPPORT DEVICE FOR WEIGHT OF A USER

(71) Applicant: Daryl Smith, Westminster, CO (US)

(72) Inventor: Daryl Smith, Westminster, CO (US)

( * ) Notice: Subject to any disclaimer, the term of this patent is extended or adjusted under 35 U.S.C. 154(b) by 826 days.

(21) Appl. No.: 13/774,972

(22) Filed: Feb. 22, 2013

(65) Prior Publication Data

US 2013/0220735 A1 Aug. 29, 2013

Related U.S. Application Data

(60) Provisional application No. 61/603,073, filed on Feb. 24, 2012.

(51) Int. Cl.
*A47C 16/04* (2006.01)
*A47C 15/00* (2006.01)

(52) U.S. Cl.
CPC ..... *A47C 16/04* (2013.01); *A47C 15/004* (2013.01)

(58) Field of Classification Search
CPC ..... A47C 16/04; A47C 15/004; A47K 3/125
USPC ..... 4/573.1, 574.1
See application file for complete search history.

(56) References Cited

U.S. PATENT DOCUMENTS

| | | | | |
|---|---|---|---|---|
| 3,680,917 | A * | 8/1972 | Harris | A47C 16/005 D24/183 |
| 3,976,155 | A | 8/1976 | Esch | |
| 4,458,784 | A | 7/1984 | Holmes, Jr. | |
| 4,867,273 | A | 9/1989 | Schaevitz | |
| D305,458 | S * | 1/1990 | Wang | D24/183 |
| 4,937,897 | A | 7/1990 | Barnabie | |
| 5,009,407 | A | 4/1991 | Watanabe | |
| D405,854 | S * | 2/1999 | Grant | D21/687 |
| 6,595,590 | B2 | 7/2003 | Bottoms | |
| 6,926,365 | B2 | 8/2005 | Bottoms | |
| D522,261 | S | 6/2006 | Whiteside et al. | |
| D562,017 | S | 2/2008 | Brewer et al. | |
| 7,856,679 | B1 | 12/2010 | Finell | |
| 2008/0022448 | A1 | 1/2008 | Todd et al. | |

OTHER PUBLICATIONS

Google Image result for "My Favorite Baby Bath Accessory: Tubsider—Bath Assistant by Infantino," babyshoppingguide.com, no date, [retrieved on Jan. 23, 2012], 1 page.
"Healthy Back Garden Kneeler," Gardeners Supply Company, no date, [retrieved on Jan. 23, 2012], 2 pages. Retrieved from: www.gardeners.com/Healthy-Back-Garden-Kneeler/37-024,default,cp.html.
"Inexpensive, Imported Prayer Kneelers," The Rosary Shop, 1995-2012, [retrieved on Jan. 23, 2012], 3 pages. Retrieved from: www.rosaryshop.com/prayerKneeler.php/request/manufactured.
"Kneeling Creepers," Construction Solutions.com, 2012, [retrieved on Jan. 23, 2012], 3 pages. Retrieved from: www.cpwrconstructionsolutions.org/masonry/solution/137/wheeled-kneelers.html.

(Continued)

*Primary Examiner* — Tuan N Nguyen
(74) *Attorney, Agent, or Firm* — Sheridan Ross, PC

(57) ABSTRACT

An ergonomic support device is provided for accommodating the weight of a user and allowing the user to perform various tasks with reduced effort. The support device is adapted for use in connection with various settings, such as bathtubs, and allows the user to work in or around a space while in a supported position.

4 Claims, 9 Drawing Sheets

(56) References Cited

OTHER PUBLICATIONS

"Prone Stander by TherAdapt," TherAdapt Products Inc., 2012, [retrieved on Jan. 23, 2012], 2 pages. Retrieved from: http://www.theradapt.com/Store/ShowProduct.aspx?ID=51.

"Safety Bath Time Easy Kneeler Deluxe," Aquatopia, no date, [retrieved on Jan. 23, 2012], 6 pages. Retrieved from: www.www.amazon.com/Aquatopia-Deluxe-Safety-Easy-Kneeler/dp/B000HIP352/ref=sr_1_1?ie=UTF8&qid=1369258757&sr=8-1&keywords=Safety-Bath-Time-Kneeler-Deluxe.

* cited by examiner

ERGONOMIC SUPPORT DEVICE FOR WEIGHT OF A USER

This Non-Provisional Application claims the benefit of priority from U.S. Provisional Patent Application No. 61/603,073 filed Feb. 24, 2012, the entire disclosure of which is incorporated by reference herein.

FIELD OF THE INVENTION

The present disclosure relates generally to support devices for aiding a user in various functions. More specifically, the present disclosure contemplates various embodiments of a device that supports at least a portion of the weight of user to simplify and provide added comfort to various activities including, for example, working in or near a tub.

BACKGROUND

In various operations, including bathing children or those in need of assistance and cleaning or accessing confined spaces or basins, a user is required to position oneself external to a defined space and reach or extend into such a space to perform various functions. These operations are known to pose risks of injury or discomfort to the user, particularly in the presence of rigid or sharp objects and corners.

Various devices for increasing the comfort of a user or worker, including those described in U.S. Pat. No. 4,458,784 to Holmes, Jr., U.S. Pat. No. 4,867,273 to Schaevitz and U.S. Pat. No. 6,595,590 to Bottoms, all of which are hereby incorporated by reference in their entireties, contemplate weight bearing structures. Known devices and disclosures, however, fail to provide various novel features of the present invention including, but not limited to, providing ergonomic support for a user at a plurality of non-discrete locations, the provision of an appropriately sized device, adjustability and/or flexibility to accommodate users and environments of various dimensions, and various other features as shown and described herein.

Accordingly, there has been a long felt and unmet need to provide an ergonomic support device for a user that increases user comfort and functionality.

SUMMARY OF THE INVENTION

Accordingly, the present invention contemplates a novel system, device, and methods for providing ease of access and comfort to a user for performing various tasks wherein a user is required to reach or extend over a space.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

In various embodiments, a curvilinear device is provided for use in connection with or adjacent to known bath and wash tubs or basins. While various embodiments are contemplated for use with a known tub comprising at least one sidewall, it will be expressly recognized that the present disclosure is not so limited. Devices and features of the present disclosure are contemplated for use with various features and in various operations. Indeed, it is contemplated that embodiments of the present disclosure provide enhanced comfort and/or utility to a variety of environments and operations including, for example, reading, plumbing, cleaning, physical therapy, massage, automotive repair, target shooting, gaming, laboratory work, and various activities where supporting at least a vector of a user's weight may be desirable.

In one embodiment, a support device is provided comprising a kneeling or knee support portion for receiving at least one knee of a user and an upper support portion for supporting, for example, the torso of the user. The knee support portion and the upper support portion are operably connected in a generally curvilinear manner such that the device comprises a single unit. As used herein, the terms and concepts of single unit, single piece, self-contained and unitary construction generally refer to the concept that a support device is connected in a manner that provides a single structure, regardless of whether or not the device comprises multiple elements.

In various embodiments, support devices of the present disclosure contemplate a user-proximal covering member for providing waterproofing and/or padding for a user. As it is one objective of the present disclosure to provide a device that supports at least a portion of a weight of a user while simultaneously providing ergonomic benefits and comfort to the user, one or more frame members for accommodating a load are provided with a covering, the covering comprising padding and/or waterproof characteristics. In various embodiments, coverings of the present invention are selectively removable, such that they may be cleaned, interchanged, etc.

Support device systems of the present disclosure further contemplate adjustability features and means for accommodating users of various different sizes, as well as tubs and structures of various different dimensions. Such adjustability features include, for example, a rotational adjustment member whereby an angle between an upper portion of the upper support member can be adjusted with respect to a remainder of the device. One or more locking pins and/or inwardly biased locking pins are provided to secure a hinge and stabilize the device in a given orientation. Rotation of at least a portion of the device may be accomplished, for example, by temporarily removing one or more pins, rotating a portion of the device to a desired angular position, and re-securing the device by inserting the at least one pin.

In various embodiments, support devices are provided with elastically deformable elements provided in the frame or structure that provide a non-rigid upper support member. In such embodiments, a user's weight is supported at least at an upper portion of the device with a predetermined amount of flexure or "give" provided such that a user may deform the device by putting increased weight or pressure on the upper portion. The device still provides sufficient resistance to the user's weight so as to provide comfort and ergonomic benefits, and returns substantially to an initial position when the weight or force is removed from the device. Various spring steels, biasing members, and elastic plastics, for example, may be provided to achieve elastically deformable features of the present disclosures.

The present disclosure further contemplates support devices or structures with stability features for increasing the safety and usability of the device. For example, in embodiments adapted for use with a tub, one of skill in the art will recognize that the application of a force upon an upper portion of the device will tend to cause the device to rotate or tip forward, potentially reducing the normal force and associated force of friction imparted upon lower portions of the device, such as the knee support portion. The application of such force(s) may cause or tend the lower portion to slide out and away from the tub, creating an unstable, unsafe, or unusable working situation. The present disclosure contemplates securing means provided on a bottom or floor-contacting portion of the device such that increased grip or support is provided. Increased grip is provided through securing means at least in a direction parallel to a ground or floor surface such that the risk of the knee support portion sliding away from a tub is at least reduced. Securing means include, but are not limited to, materials comprising a high coefficient(s) of friction, such as rubber, suction cups, and/or feet. Provision of securing means is not limited to a floor or ground-contacting portion of the device. Rather, such features may be provided at any number of locations along a support device, including in connection with an upper support portion for contacting a lip or ledge of a tub.

In various embodiments, a supporting device is provided comprising the ability to translate the device laterally while resisting a tendency of a lower or knee support portion to slide "out" or away from a tub. Such embodiments provide the functionality of translating laterally along a tub to perform various tasks and increase a user's working area. For example, in a particular embodiment, it is contemplated that rollers or wheels are provided on an underside of a knee support of the device, the rollers or wheels comprising a fixed orientation such that they allow for left-right lateral translation of the device but resist a perpendicular movement of the device away from the tub. Additionally, support members may extend into a tub and provide force-transmitting contact with an inner wall of the tub. Such support members in combination with rigid or semi-rigid characteristics of the device resist the undesired outward movement of the device. Various support means may be provided in combination or in place of one another and various other supporting features as shown and described herein.

One of skill in the art will recognize that various tubs and devices for use in combination with embodiments of the present disclosure will vary in size. Tub heights, for example, typically range between 15" and 19". Embodiments of the present disclosure are therefore contemplated as comprising an overall device height of anywhere between approximately 10 inches and approximately 40 inches. In a preferred embodiment, a support device comprises an overall device height of approximately 20 inches to approximately 30 inches. In a more preferred embodiment, a support device comprises an overall height of approximately 26 inches. Similarly, the width of a support device may vary. In various embodiments, support devices comprise widths of between approximately 8 inches and approximately 32 inches. In preferred embodiments, support devices comprise a width of between approximately 10 inches and approximately 20 inches.

It will be expressly recognized that support devices of the present invention are not limited to any specific dimension or proportion. Although preferred embodiments are shown and described herein, it will be understood that support devices of the present invention may be of any size. Devices are contemplated that span substantially the entire width of various tubs. Devices are also contemplated that are less wide, such as may be provided for use with a sink or narrow tub.

Upper support portions of various embodiments of the present disclosure provide structural support to the user, specifically in the back and neck region. Knee support portions provide further comfort, support and stability. The upper support portion is adjustable to form various different arcs or angles to accommodate various user's body size and preferences.

In various embodiments, a stabilizing structure is provided for communication with a portion of a tub. The stabilizing structure comprises a laterally stabilizing member, such as an adjustable padded horizontal member which may be translated to accommodate various different tub heights.

In preferred embodiments, the upper support area is sufficiently narrow to allow the user free movement of their arms. Various portions of the support device, including the upper support area and/or lateral support member may comprise features or compartments for receiving toiletries or other useful items.

Accordingly, embodiments of the present disclosure provide various features and benefits, including but not limited to supporting a user in a more comfortable position wherein the user's torso is supported, providing a cantilevered flexible or semi-flexible design that accommodates user of different body types, employing a user's body weight in combination with non-skid bottom features and other supporting means to stabilize the system, providing optional foldable features for ease of storage and/or transport, preferred sizing to allow for storage with consideration given to building code standards between vanities and tubs, a removable cover portion comprised of any one of a variety of materials, and enhanced safety features including minimal moving parts.

In one embodiment, a support device of the present disclosure comprises bendable memory foam or rubber/plastic material which can be shaped around a rigid object and generally return to an initial orientation when not in use. Various shape-memory polymers may be employed in combination with or in lieu of various support or frame structures.

In various embodiments, the present invention comprises a support device with a frame member. The frame member comprises various features, including the ability to provide structural support and adjustment features to accommodate different sized users and different sized tubs or workspaces. In certain embodiments, a plurality of telescoping members is provided. For example, it is contemplated that a support device of the present invention comprise a base member within which a tub attachment or support portion telescopes or translates, such that a tub-interface portion of the device is adjustable based on a height of a portion of a tub or workspace. It is further contemplated that a torso-support member or portion of the device is adjustable or translatable relative to at least one of the base member and the tub attachment portion. In such embodiments, the device is adjustable to accommodate for different tub/workspace heights as well as various user heights.

In one embodiment, a support device for positioning proximal to a defined space and supporting a user over the defined space, the device comprising a frame member comprising a lower portion, a central portion, and an upper portion, the lower portion comprising a support portion for receiving the knees of a user and the upper portion comprising a support portion for the torso of a user. The lower portion extends upwardly toward the central portion and at least a portion of the lower portion is disposed substantially perpendicular to at least a portion of the central portion. The central portion extends upwardly into the upper portion, the upper portion comprises a curvilinear portion extending out over the defined space, and at least one of the upper portion, the central portion, and the lower portion are translatable with respect to one of said portions. The device may further comprise a cover member on an opposing portion of the device from the defined space, the cover member comprising a user interface portion and the device adapted for selectively placement adjacent a workspace.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
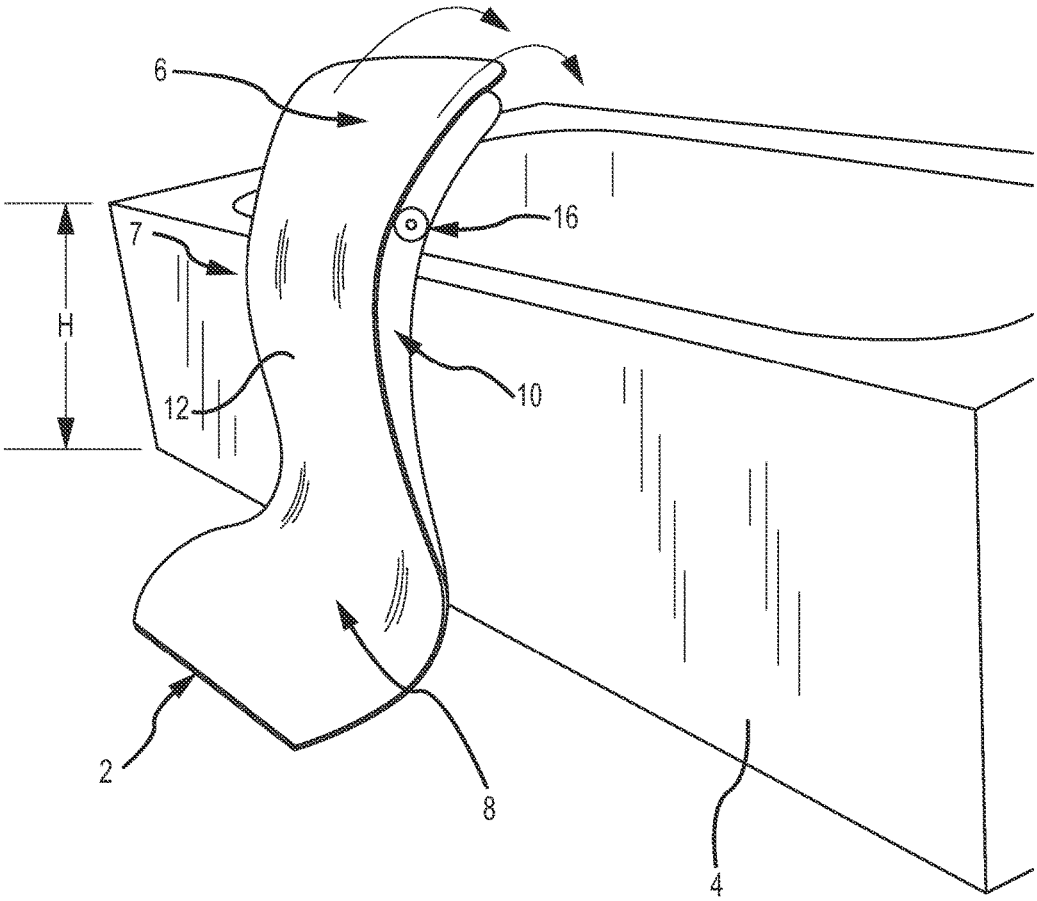
Figure 2:
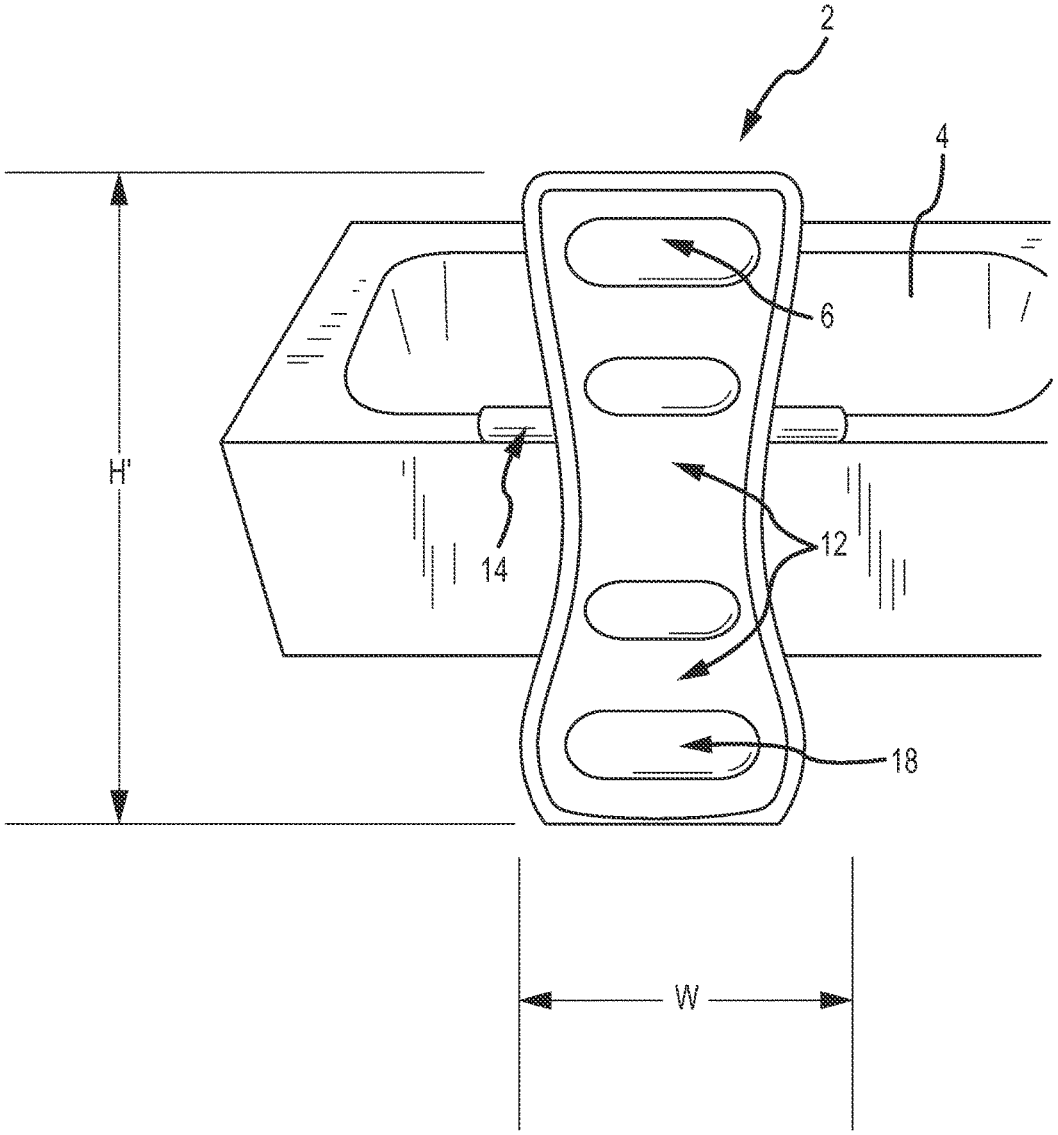
Figure 3:
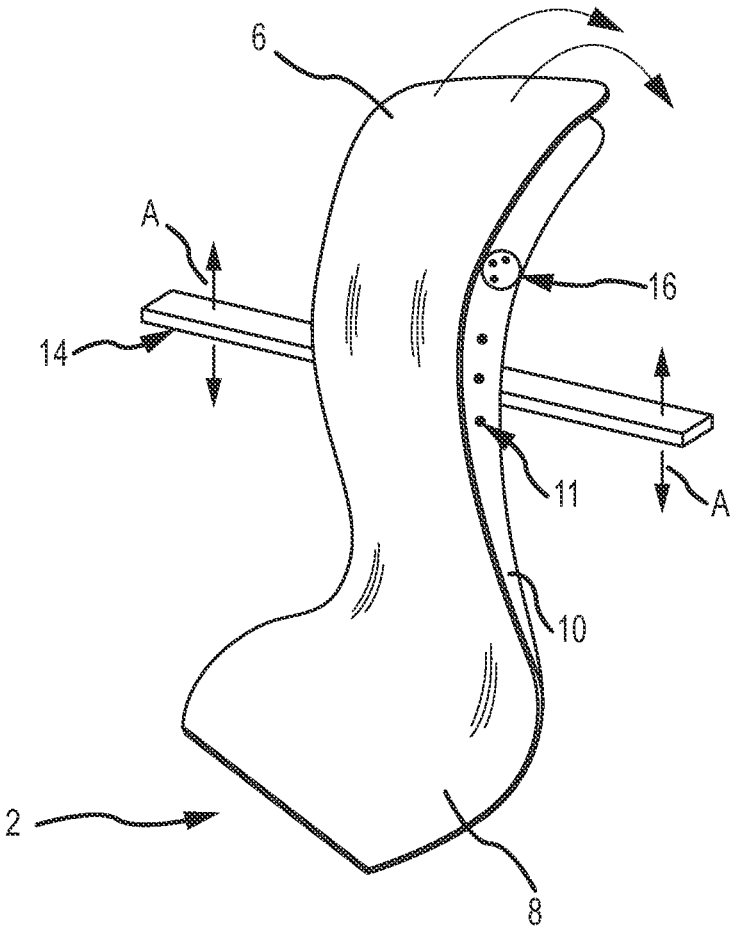
Figure 4:
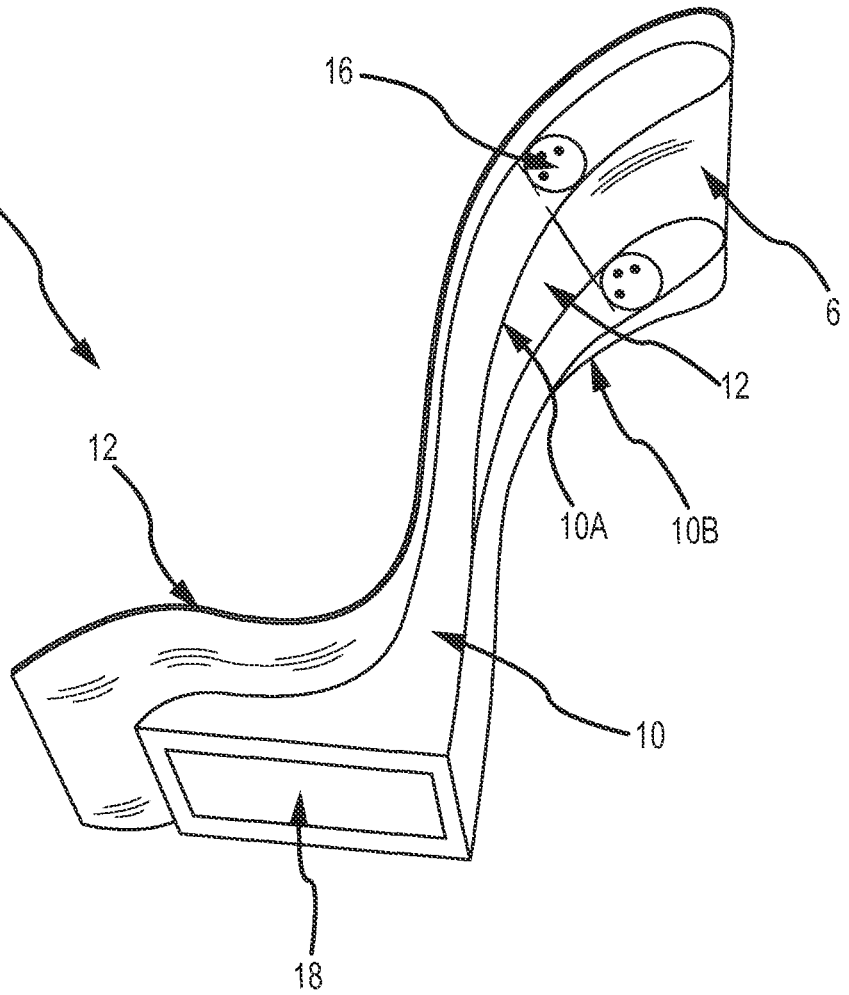
Figure 5:
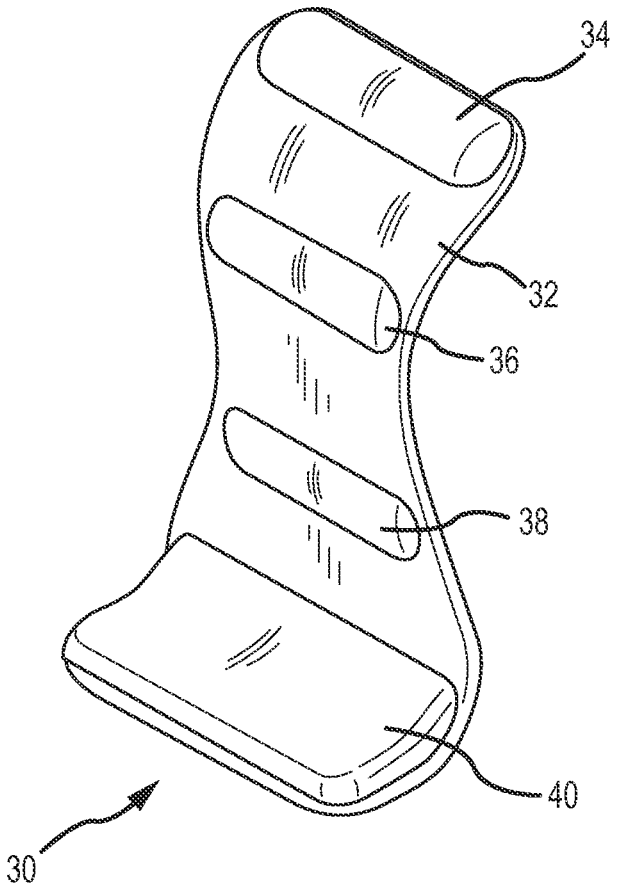
Figure 6:
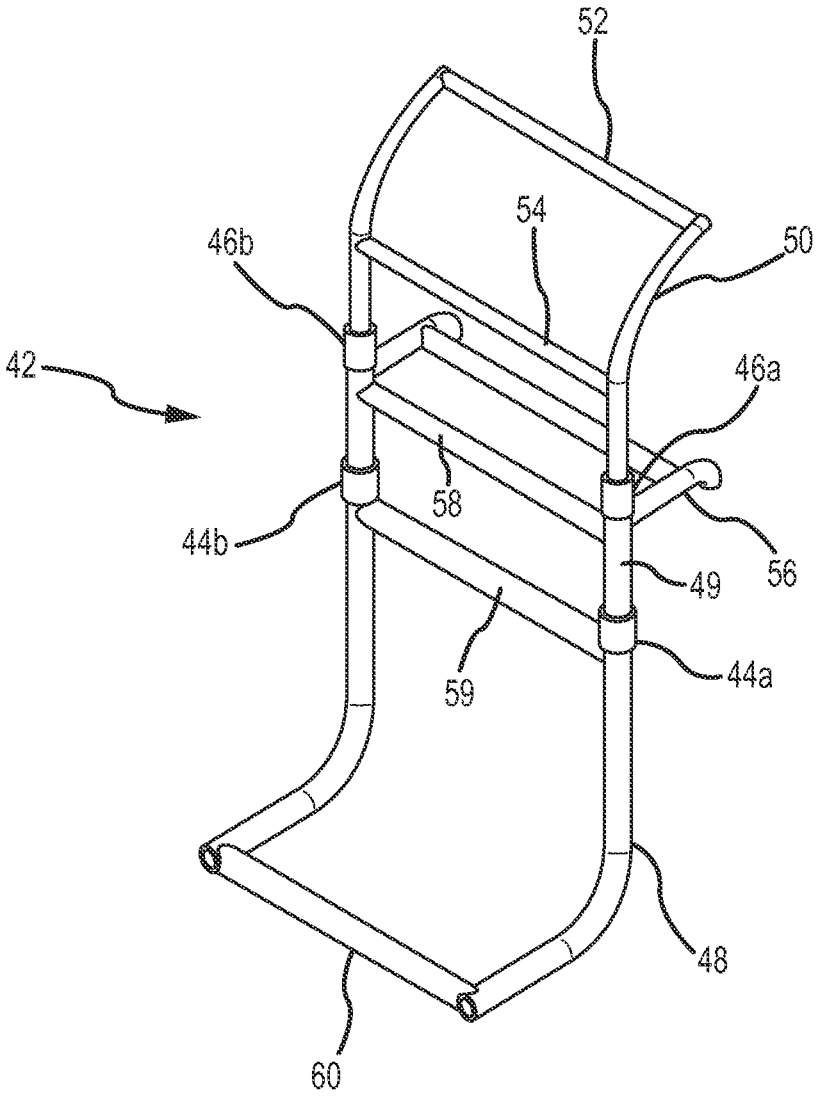
Figure 7:
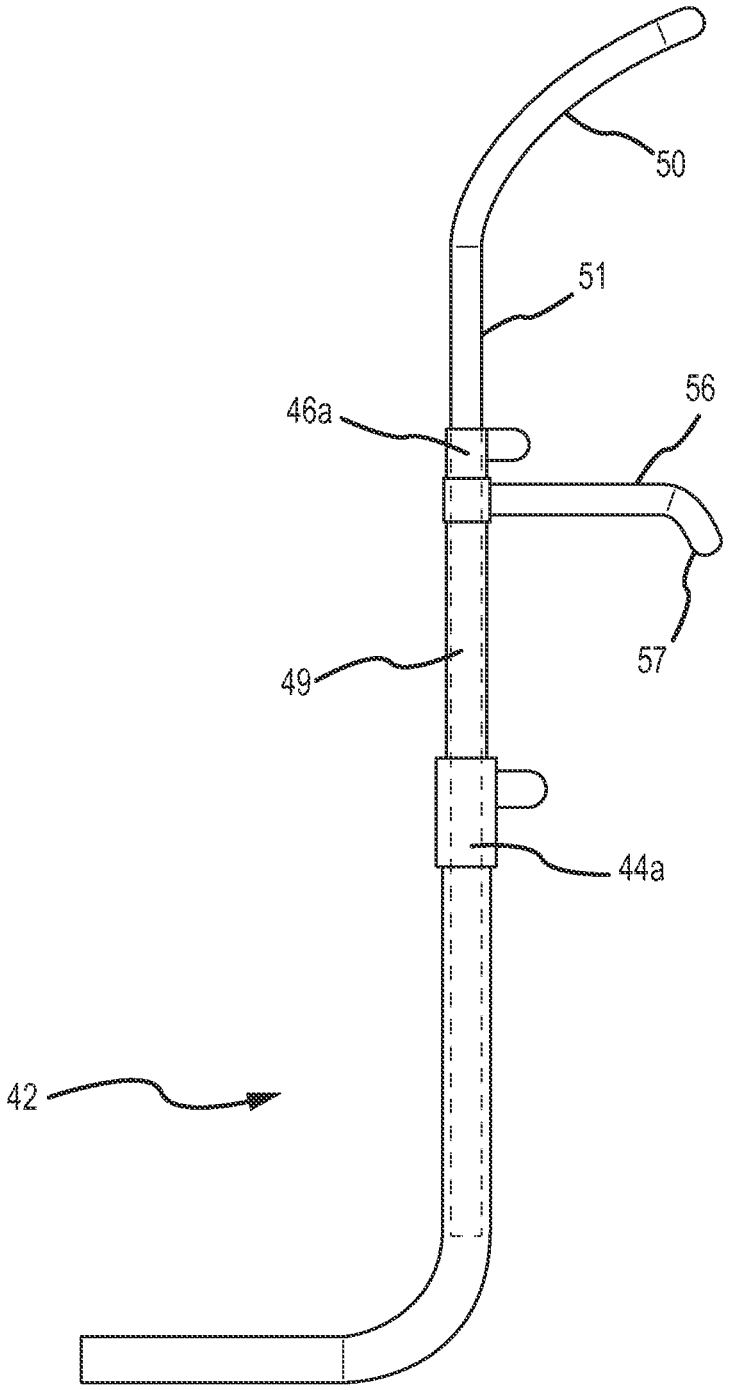
Figure 8:
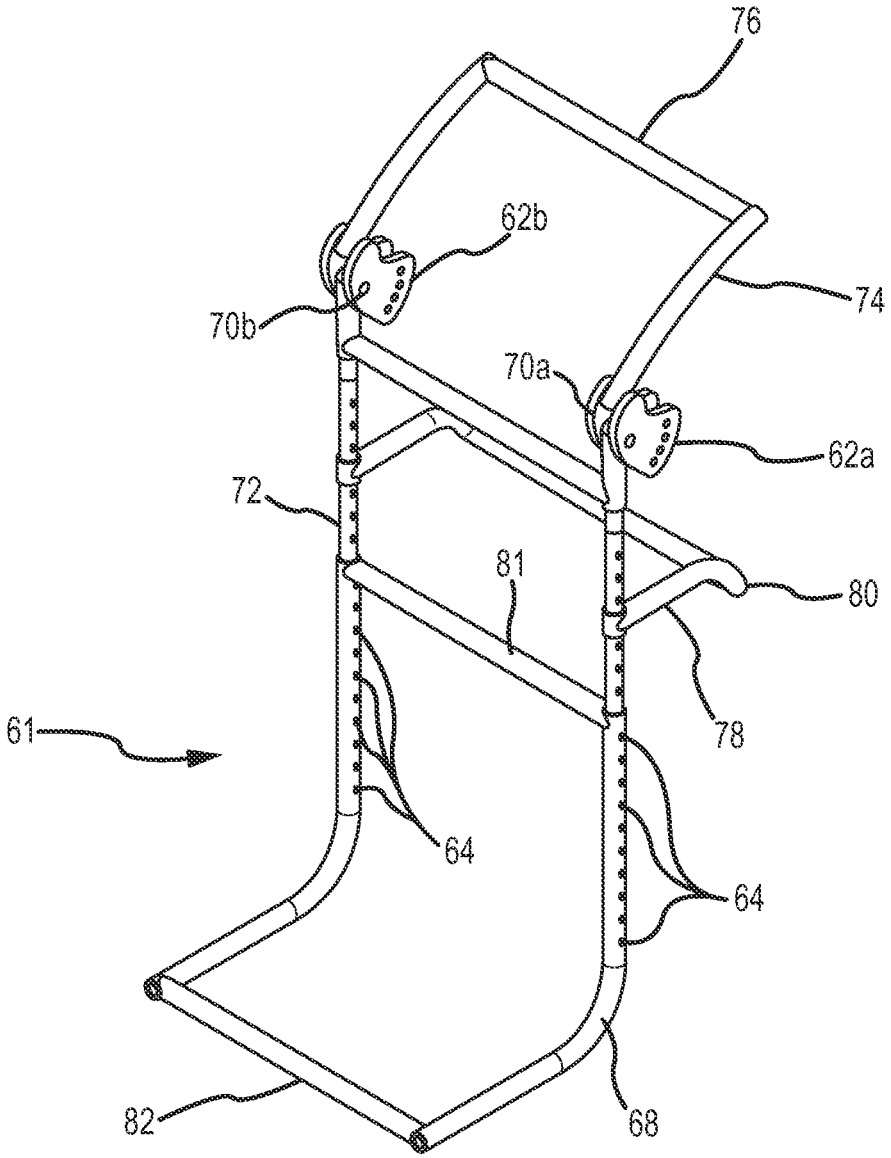
Figure 9:
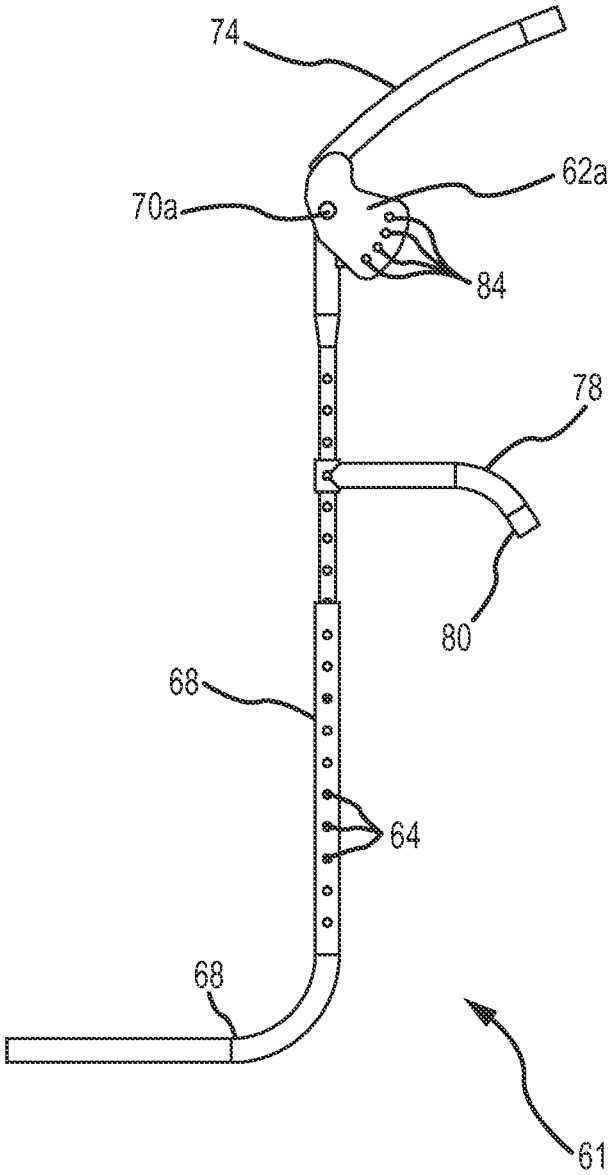

FIG. 1 is a front perspective of a support device according to one embodiment;

FIG. 2 is perspective of a support device according to one embodiment;

FIG. 3 is perspective of a support device according to one embodiment;

FIG. 4 is a bottom perspective of a support device according to one embodiment;

FIG. 5 is a front perspective of a support device according to one embodiment;

FIG. 6 is a front perspective of a support device feature according to one embodiment;

FIG. 7 is a side elevation view of a support device feature according to one embodiment;

FIG. 8 is a front perspective of a support device feature according to one embodiment; and FIG. 9 is a side elevation view of a support device feature according to one embodiment.

DETAILED DESCRIPTION

The present invention has significant benefits across a broad spectrum of endeavors. It is the applicant's intent that this specification be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention.

The detailed description is to be construed as exemplary only and does not describe every possible embodiment since describing every possible embodiment would be impractical, if not impossible. Numerous alternative embodiments could be implemented, using either current technology or technology developed after the filing date of this patent.

Referring now to FIGS. 1-4, a support device 2 according to various embodiments of the present invention is shown. It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

In various embodiments, the support device 2 is provided for use in connection with a pre-existing tub 4 or similar feature. While preferred embodiments of the present disclosure are provided for use in connection with various known bathtubs, it will be expressly recognized that the present invention is not limited to use in connection with any particular device or function. Indeed, various embodiments of support devices 2 are contemplated for use with any function or task where at least partial support of a user's body weight is desired. Such functions or task include, but are not limited to providing assistance for performing work within or over a tub, automotive repair, various desk-related activities, reading, plumbing activities, etc.

Referring now to FIG. 1, a perspective view of one embodiment of a support device 2 is shown in communication with a tub 4. The tub 4 is depicted as a standard bathing tub with a basin for containing water and aiding in various bathing functions. The tub 4 has a predetermined height H above a ground or floor surface. One of skill in the art will recognize that various tubs, such as claw-foot tubs, alcove tubs, drop-in tubs, freestanding tubs, and corner tubs, comprise various different heights H. Various embodiments of a support device 2 accommodate a variety of different tub heights.

The support device 2 comprises a device of substantially integrated construction. That is, various embodiments of the device 2 comprise substantially single-piece or self-contained construction and/or are comprised of segments or portions that are connected in such a manner that the device 2 does not comprise multiple unattached components. As shown, the depicted embodiment provides a device 2 comprising a contoured platform with a contoured upper portion 6 connected to a knee support 8. In various embodiments, an outer or user-proximal portion of the device 2 comprises a soft or compressive structure on the upper contoured portion 6 and/or knee support 8 to increase the comfort of a user (not shown). In various embodiments, for example, the outer portion of at least one of the upper portion 6 and knee support 8 comprise an ergonomic or user-friendly material such as EVA foam, nitrile rubber, polyurethane, visco-elastic polyurethane foam, closed cell foam(s)—including, for example, polyethylene foam, volara foam, minicel foam, polystyrene, neoprene, and gymnastic rubber—and various combinations thereof. In various embodiments, such ergonomic materials for increasing grip and user-comfort are provided over substantially the entire surface area of the device 2. In alternative embodiments, specific portions of the device 2, such as defined areas for supporting a user's knee(s) and/or chest are provided with such a material.

In one embodiment, the support device 2 comprises an outer covering 12 over substantially the entire surface area of the device 2. The outer covering 12 comprises waterproof or semi-waterproof characteristics for preventing water from penetrating various aspects of the support 2. The outer covering 12, which is selectively detachable in various embodiments, is provided in connection with a frame or base member 10. The frame 10 comprises a substantially rigid structure for supporting at least a portion of the weight of a user. As shown in FIG. 1, the substantially rigid structure 10 comprises an at least partially curved member for conforming to a tub 4. The device 2 is arranged such that a user is provided with knee rests/support 8 for receiving a normal force and a curved upper portion 6 extending to or above a height H of the tub 4 for supporting the chest of a user when the user is working on, in, or next to the tub 4. The user may thus kneel comfortably adjacent a tub 4 and perform various activities, including but not limited to bathing children, while the device 2 supports the user at a plurality of locations. Various embodiments of the present disclosure support a user at a non-discrete number of locations to provide maximum comfort and range of motion. For example, where various known devices simply provide vertical shock absorption for knees and elbows, embodiments of the present disclosure provide support in a plurality of vectors, thus reducing stress on substantially all areas of the body of a user.

Various embodiments of the present disclosure further comprise an adjustment feature 16 for varying the configuration of the device 2. As will be recognized, tubs as well as users come in various shapes and sizes. In order to accommodate a wide variety of users, devices, needs, etc., the present disclosure contemplates a support device 2 comprising an angular adjustment 16 for adjusting an angular position of an upper member 6 of the device 2. In various embodiments, the angular adjustment 16 comprises a lockable hinge member about which an upper portion 6 may be selectively rotated with respect to a remainder of the curvilinear support member 7. The angular adjustment 16 may comprise any number of known features and devices for selectively altering position, including, for example, one or more inwardly biased pin members which inhibit rotation of elements when disposed in a first position and enable rotation of elements when disposed in a second outward position. For example, locking ladder hinges and similar systems may be incorporated into embodiments of the present invention to provide for selective rotation of various elements.

In various embodiments, an interconnecting structural design is provided to aid in packing and shipping of the device, as well provide enhanced adjustability. For example, various portions of the device 2 may be provided in sections and selectively secured to one another by a number of means and methods, including but not limited to outwardly biased push-pins and similar features. A lower portion of the frame may be provided with a plurality of receiving portions, each provided at different angles, for receiving an upper portion and selectively varying the angle at which the upper portion is disposed.

The upper portion 6 and angular adjustment 16 allow for rotation of the upper portion 6 with respect to a remainder of the device 2 while still providing support for at least an upper body portion of a user, regardless of the angular position at which an upper portion 6 is disposed. Accordingly, embodiments of the present invention are capable of accommodating any number of user sizes, tub sizes, and combinations thereof.

In one embodiment, the support 10 of the device 2 comprises a partially flexible or compliant member capable of accommodating at least a portion of the weight of a user. In such an embodiment, the support 10 comprises a semi-rigid elastic member as opposed to a rigid member, the semi-rigid member comprising properties that flex or yield under the weight of a user yet retains its initial shape when the weight is removed.

FIG. 2 is a front perspective view of one embodiment of the present disclosure. As shown, a support device 2 comprising a height H' and a width W is positioned proximal to a tub 4. In addition to a knee support portion 8 and upper support portion 6, a lateral support member 14 is further provided to aid in lateral or horizontal stability of the device 2. The lateral support member 14 comprises a substantially rigid member which extends downwardly and/or outwardly from the device 2 and prevents or minimizes risk of side-to-side tipping of the device 2. In various embodiments, the device 2 comprises one or more securing members, such as suction cups, to secure the device 2 to a tub 4 or similar feature. Securing members may be provided on a frame portion 10 of the device 2 and/or on the lateral support member 14. The lateral support member 14 is adjustable in a vertical or height direction in certain embodiments to allow the device 2 to accommodate different tub heights.

FIG. 3 is a perspective of one embodiment of the present disclosure wherein a lateral support member 14 is provided, the lateral support member 14 being adjustable in at least a vertical direction A in order to accommodate various different heights of tubs or other structures. Pin or fastener receiving members 11 are provided along a height of the support 10. The lateral support member 14 may be secured in various height positions generally corresponding to the fastener receiving members 11.

FIG. 4 is a bottom perspective of one embodiment of a support device 2 in accordance with the present disclosure showing a base portion 18. Base portion 18 preferably comprises means for preventing unwanted translation or rotation the device 2, particularly when a user's weight is applied. While a user's weight will impart a normal force and corresponding force of friction on the base portion 18, one will recognize that a rotational force will be imparted upon the device when the upper portion 6 is weighted. This force will tend the device 2 to rotate clockwise (with respect to FIG. 4), and urge the base portion 18 to slide or move away from a tub or worksite. In order to eliminate or minimize the risk of such unwanted translation, the present disclosure contemplates various means for stabilizing the device 2. For example, base portion 18 may be provided with various materials comprising a relatively high coefficient of friction, such as rubber. The material may be provided in the form of one or more feet or protrusions, and/or may be dispersed over substantially the entirety of the surface area of the base 18.

As shown in FIG. 4, a frame portion 10 of the device 2 comprises two substantially parallel structures 10A, 10B for supporting a load, particularly when a user leans or extends out over a workspace. In various embodiments, structures 10A, 10B comprise elastic structures that the user to deform the frame 10, yet still provide adequate support to reduce stress and strain on the user's back. The amount of elasticity and resistance of the device 2 may be varied by providing various different materials of desired Young's Modulus and preferred geometry.

Various building codes and requirements require or specify certain dimensions for spacing between tubs and vanities. For example, the current minimum standard for the spacing between an installed tub or toilet and an installed vanity is 30 inches. This space is more typically provided at approximately 32 inches. It is thus typical to have approximately 15-16 inches of space between an installed toiled and a tub or vanity structure, such space being useful for installing or servicing items and otherwise generally unused. Embodiments of the present disclosure contemplate utilizing such space as storage for at least one support device when the device is not in use. Support devices may be sized to fit within this predetermined space and/or may be foldable to reduce overall dimensions such that the device can be fit in this space. In one embodiment, a knee support portion 8 is foldable or hinged with respect to a remainder of the device 2 such that the depth of the device 2 can be reduced and easily stored. Additionally, various embodiments of the present disclosure contemplate at least partially flexible support members which provide support to a user as well as allow the device to compressed or stored.

FIG. 5 is a perspective view of a device 30 according to one embodiment of the present invention, the device 30 comprises a curvilinear platform 32, a first padded or user support portion 40, and a plurality of torso supports 34, 36, 38. The contoured shape of the platform 32 can be achieved with heat molded material such as plastics or other composite material. The platform 32 is adapted to be provided in combination with, for example, an additional support structure as shown and described herein. The platform 32 comprises, in certain embodiments, relief cuts or pleats to allow for movement of telescoping tubing provided with a support structure. The platform 32 may be provided with a waterproof elastic fabric that is secured, for example, via an interior hook and loop system that allows torso supports 34, 36, 38 to be positioned in various locations, such as where it is most comfortable for the user's body type. For example, torso supports 34, 36, 38 could be turned vertical versus horizontal and/or more cushions could be placed in certain locations deemed more suitable for user.

As shown, a knee support 40 is provided, the support 40 being affixed to the platform for knee comfort and support. Various supports 34, 36, 38, 40 are contemplated as being in fixed communication with the device 30. Alternatively, it is contemplated that such features are selectively removable from the device 30 and therefore selectively positionable based on user preference. It is contemplated that the heat formed platform structure 30 be provided as a stand-alone molded structure, without an additional internal support structure for supporting a user. In such an embodiment, the molded structure 30 is provided with the necessary horizontal stability through at least the knee support section 40 provided at the base of the platform 30. Alternatively, however, it is contemplated that the structure 30 be provided with an additional support structure or structures, as described herein. Thus, in at least some embodiments, the structure 30 is contemplated as comprising a cover portion for an additional device(s).

FIGS. 6-7 depict one embodiment of an adjustable frame structure 42 according to one embodiment of the present invention. The frame structure 42 generally comprises three interconnected portions 48, 49, 50 that are translatable with respect to one another. That is, portions 48, 49, 50 comprise tubing structures wherein central portion 49 is in translatable, telescoping interconnection with a base portion 48 and upper portion 50 is in translatable, telescoping interconnection with the central portion 49 (and therefore, by extension, base portion 48). The frame structure 42 is provided with securing means 44*a*, 44*b* for selectively enabling and limiting translation of base portion 48 and central portion 49. Similarly, the frame structure 42 further comprises securing means 46*a*, 46*b* for selectively enabling and limiting translation of upper portion 50 and central portion 49. Securing means include, but are not limited to, snap locks such as those commercially available through Testrite®, twist locks, c-clamps, quick release c-clamps, bicycle seatpost clamps, pin and socket features, and various features similar thereto as will be recognized by one of skill in the art.

Upper portion 50 provides a torso support feature for a user. In the depicted embodiment, the height of the upper portion 50 is variable at least in part due to the telescoping nature of the upper portion 50 with respect to the central portion 49 and the central portion 49 with the base portion 48. Accordingly, the upper portion 50 is adapted to accommodate and support users of various different heights and dimensions. The central portion 49 comprises an extension member 56, the extension member 56 adapted for communication with, for example, a lip or edge of a tub or basin. By providing the central portion 49 in a telescoping arrangement with at least the base portion 48, the central portion 49 and associated extension member 56 are selectively adjustable such that the extension member may be selectively provided in communication with an upper edge, lip, or periphery of a tub. For example, it is contemplated that the central portion 49 and associated extension member 56 be provided in a position above the lip of a tub, the device 42 subsequently positioned adjacent to the tub, the central member 49 and extension member 56 lowered via manipulation of securing means 44*a*, 44*b* such that extension member 56 is in contact with the tub, and the central member thereafter secured via securing means 44*a*, 44*b*. Subsequent thereto, and with the extension member 56 provided in a desired position to communicate with the tub and secure the device 42, the upper portion 50 may be adjusted in a telescoping manner to set the upper portion 50 at a user-desired height.

In the depicted embodiment, cross-bar supports are provided to enhance the overall rigidity of the device. For example, upper portion 50 is provided with cross-bars 52, 54. Central portion 49 comprises at least one cross-bar 58. Base portion comprises a plurality of cross-bar supports 59, 60. It will be recognized, however, that various alternative embodiments are contemplated and the specific arrangement of these support members are not critical to the present invention. Various alternatives to the depicted cross-bars are contemplated. It is contemplated, for example, that a covering provided over the frame member 42 provides at least some of the requisite or desired torsional stability.

FIG. 7 is a side elevation view of the device 42 of FIG. 6. As shown, an upper portion 50 comprises a curvilinear portion for ergonomically supporting a weight of a user and allowing the user to lean over or access a tub. The upper portion 50 transitions downwardly into a substantially linear portion 51, the substantially linear portion 51 being translatable in a telescoping manner at least within the central portion 49. The substantially linear portion 51 is selectively securable via securing means 46*a* (and 46*b*, not shown). The radius of curvature of upper portion 50 is depicted as being substantially fixed in FIG. 7. It will be recognized, however, that such a radius or curvilinear shape may be adjustable as shown and described herein.

Although not depicted in FIGS. 6-7, various non-skid and/or non-scratch materials are contemplated as being provided in combination with the device 42 as well as other embodiments. For example, one or more rubberized feet or protrusions are provided on a portion of the base 48 for contacting a floor surface and/or on an underside of the extension 56. The extension 56 comprises a flanged or curved portion 57 for communication with an inner lip or portion of a tub.

FIGS. 8-9 depict one embodiment of a support device 61 according to the present invention. As shown, the device 61 generally comprises three interconnected portions 68, 72, 74 that are translatable with respect to one another. That is, portions 68, 72, 74 comprise tubing structures wherein central portion 72 is in translatable, telescoping interconnection with a base portion 68 and upper portion 74 is in translatable, telescoping interconnection with the central portion 72 (and therefore, by extension, base portion 68). The frame structure 61 is provided with securing means for selectively enabling and limiting translation of base portion 68 and central portion 72. Similarly, the frame structure 61 further comprises securing means for selectively enabling and limiting translation of upper portion 74 and central portion 72. Securing means include, but are not limited to, snap locks such as those commercially available through Testrite, twist locks, c-clamps, quick release c-clamps, bicycle seatpost clamps, pin and socket features, and various features similar thereto as will be recognized by one of skill in the art. In the depicted embodiment, securing means comprise a plurality of holes or sockets 64 provided at a plurality of vertical positions. One or more pins are provided, the pins being selectively removable and inserting so as to secure the portions in a desired relationship and establish a desired height.

Upper portion 74 provides a chest support feature for a user. In the depicted embodiment, the height of the upper portion 74 is variable at least in part due to the telescoping nature of the upper portion 74 with respect to the central portion 72 and the central portion 72 with the base portion 68. Accordingly, the upper portion 74 is adapted to accommodate and support users of various different heights and dimensions. The central portion 72 comprises an extension member 78, the extension member 78 adapted for communication with, for example, a lip or edge of a tub or basin. By providing the central portion 78 in a telescoping arrangement with at least the base portion 68, the central portion 72 and associated extension member 78 are selectively adjustable such that the extension member may be selectively provided in communication with an upper edge, lip, or periphery of a tub. For example, it is contemplated that the central portion 72 and associated extension member 78 be provided in a position above the lip of a tub, the device 61 subsequently positioned adjacent to the tub, the central member 72 and extension member 78 lowered via manipulation of securing means such that extension member 78 is in contact with the tub, and the central member thereafter secured via securing means. Subsequent thereto, and with the extension member 78 provided in a desired position to communicate with the tub and secure the device 61, the upper portion 74 may be adjusted in a telescoping manner to set the upper portion 74 at a user-desired height.

In the depicted embodiment, cross-bar supports are provided to enhance the overall rigidity of the device. For example, upper portion 74 is provided with cross-bar 76. Base portion comprises a plurality of cross-bar supports 81, 82. It will be recognized, however, that various alternative embodiments are contemplated and the specific arrangement of these support members are not critical to the present invention. Various alternatives to the depicted cross-bars are contemplated. It is contemplated, for example, that a covering provided over the frame member 42 provides at least some of the requisite or desired torsional stability.

As further shown in FIGS. 8-9, it is contemplated that various embodiments of the present invention comprise angularly adjustable upper portions. For example, and as shown in FIGS. 8-9, locking hinge members 62*a*, 62*b* are provided, the hinges comprising a pivot point 70*a*, 70*b* about which the upper portion 74 is rotatable with respect to a remainder of the device 61. The hinges comprise a plurality of apertures 84 associated with a plurality of different angular positions of the upper portion 74 of the device.

In various embodiments, the support cover portion 30 is provided in combination with frame structures disclosed herein. For example, in one embodiment, a formed cover such as that shown in FIG. 5 is provided in combination with a frame structure as depicted in FIGS. 6-9. It will be expressly recognized that various features shown and described herein are not limited to the particular embodiment(s) they may be discussed in combination with. Indeed, it is contemplated that various features of the present invention may be substituted with or provided in combination with various additional features.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A support device for positioning proximal to a defined space and supporting a user over the defined space, the device comprising:

a molded curvilinear platform comprising a lower portion, a central portion, and an upper portion, wherein the lower portion, the central portion and the upper portion are contiguous and the lower portion comprises a kneeler having a pad operable to receive the knees of a user and the upper portion comprises a support portion for the torso of a user;

the lower portion comprising a first padded portion operable to support a user, the lower portion extending upwardly toward the central portion and at least a portion of the lower portion being disposed substantially perpendicular to at least a portion of the central portion;

the central portion extending upwardly into the upper portion, the upper portion comprising a curvilinear portion extending out over a defined space; and wherein the device is adapted for selective placement adjacent a workspace and wherein the device comprises at least one elastically deformable element; and wherein the platform comprises a plurality of spaced apart torso supports distributed along a length of the device, and the lower portion comprises a plurality of gripping elements for engaging a surface upon which the device is disposed and increasing friction with respect to the surface;

wherein the upper portion comprises a convex portion comprising at least one of the torso supports, and a concave portion operable for placement adjacent to the workspace, and wherein the support device comprises a height of between approximately 20 and approximately 30 inches.

2. The support device of claim 1, wherein the securing means comprise at least one rubber feet and suction cups.

3. The support device of claim 1, wherein the pad of the lower portion and the torso supports comprise a material selected from the group consisting of: EVA foam, nitrile rubber, polyurethane, visco-elastic polyurethane foam, and a closed cell foam.

4. A support device for positioning proximal to a defined space and supporting a user over the defined space, the device comprising:

a molded curvilinear platform comprising a lower portion, a central portion, and an upper portion, wherein the lower portion, the central portion and the upper portion are contiguous and the lower portion comprises a kneeler having a pad operable to receive the knees of a user and the upper portion comprises a support portion for the torso of a user;

the lower portion comprising a first padded portion operable to support a user, the lower portion extending upwardly toward the central portion and at least a portion of the lower portion being disposed substantially perpendicular to at least a portion of the central portion;

the central portion extending upwardly into the upper portion, the upper portion comprising a curvilinear portion extending out over a defined space; and wherein the device is adapted for selective placement adjacent a workspace and wherein the device comprises at least one elastically deformable element; and the lower portion comprises a plurality of gripping elements for engaging a surface upon which the device is disposed and increasing friction with respect to the surface;

wherein the upper portion comprises a convex portion comprising at least one torso support, and a concave portion operable for placement adjacent to the workspace; and wherein the support device comprises a height of between approximately 20 and approximately 30 inches.

* * * * *